United States Patent [19]

Beaulieu et al.

[11] Patent Number: 4,755,151

[45] Date of Patent: Jul. 5, 1988

[54] BRIDGING LINK FOR ELECTRICALLY CONNECTING INSULATION DISPLACEMENT TERMINALS

[75] Inventors: Laurence A. J. Beaulieu, Kanata; George Debortoli, Ottawa, both of Canada

[73] Assignee: Northern Telecom Limited, Montreal, Canada

[21] Appl. No.: 45,354

[22] Filed: May 4, 1987

[51] Int. Cl.[4] ..... H01R 4/24

[52] U.S. Cl. ..... 439/395; 439/511

[58] Field of Search ..... 439/391, 400–404, 439/395, 396, 417–419, 511

[56] References Cited

U.S. PATENT DOCUMENTS 3,824,530 7/1974 Roberts et al. ..... 439/399

*Primary Examiner*—Joseph H. McGlynn

*Attorney, Agent, or Firm*—R. J. Austin

[57] ABSTRACT

A bridging link is disclosed for electrically connecting each of a selected pair of insulation displacement terminals of a first terminal array to a respective one of a corresponding pair of insulation displacement terminals of a second terminal array. The bridging link comprises a dielectric body including a rigid housing, a first pair of spaced apart electrical contact members projecting from a first region of the housing, and a second pair of spaced apart electrical contact members projecting from a second region of the housing which is spaced apart from the first region. The contact members of the first pair are electrically connected through the housing each to a respective one of the contact members of the second pair. Each contact member of the first pair may be inserted into a respective one of the selected pair of terminals, while each contact member of the second pair is inserted into a respective one of the corresponding pair of terminals, thereby electrically connecting terminals of the first array to terminals of the second array as desired. The bridging link is useful in distribution frames for telephone exchanges.

10 Claims, 5 Drawing Sheets

BRIDGING LINK FOR ELECTRICALLY CONNECTING INSULATION DISPLACEMENT TERMINALS

The invention relates to a bridging link for electrically connecting insulation displacement terminals of one terminal array to insulation displacement terminals of another terminal array.

Insulation displacement terminal arrays are commonly used in distribution frames of telephone exchanges. It is frequently necessary to electrically connect each of a selected pair of terminals to one terminal array to a respective one of a corresponding pair of terminals of an adjacent array. This is typically done by connecting a bridging link in the form of a flexible wire to each of the selected pair of terminals, and bridging each wire to a respective one of the corresponding pair of terminals. This operation requires separate insertion of each end of each wire with an insertion tool, and trimming of each wire to length.

Because the wires cannot generally be reused, the above steps must be repeated every time such a connection is interrupted for test purposes. Moreover, the size and density of the terminal arrays make slight misalignment of the connecting wires difficult to avoid and detect. Such misalignments result in erroneous connections.

The invention seeks to provide a bridging link which facilitates efficient and error-free electrical connection of a terminal of one terminal array to a respective terminal of another terminal array.

Accordingly, the invention provides a bridging link for electrically connecting each of a selected pair of insulation displacement terminals of a first array of pairs of insulation displacement terminals carried by a first terminal carrier to a respective one of a corresponding pair of insulation displacement terminals of a second array of insulation displacement terminals carried by a second terminal carrier, comprising: a dielectric body comprising a rigid housing; a first pair of spaced apart electrical contact members projecting from a first region of the rigid housing, each contact member of the first pair for insertion into a respective one of the selected pair of terminals to make electrical contact therewith; and a second pair of spaced apart electrical contact members projecting from a second region of the rigid housing and spaced apart from the first region, each contact member of the second pair for insertion into a respective one of the corresponding pair of terminals to make electrical contact therewith; the contact members of the first pair electrically connected through the rigid housing each to a respective one of the contact members of the second pair.

In use of a bridging link according to the invention, no insertion of trimming tool is required, and the connection may be made with a single insertion step while simultaneously connecting two terminals of one array with two of the other. Moreover, bridging links according to the invention are readily disconnected and reconnected for test purposes. The rigidity of the bridging link prevent erroneous connections due to misalignment.

Advantageously, the body of the bridging link may carry latching parts for cooperation with complementary latching parts of the terminal carriers to releasably latch the bridging link onto the terminal carriers. Preferably, each latching part comprises a latch integrally formed with the housing at a base of the latch and resiliently movable from a normal position relatively close to an associated one of the pairs of contact members to a strained position further removed from said associated pair of contact members.

Conveniently, each conductor may comprise a fuse to provide sneak current protection.

Embodiments of the invention will now be described, by way of example only, with reference to the accompanying drawings, in which.

Figure 1:
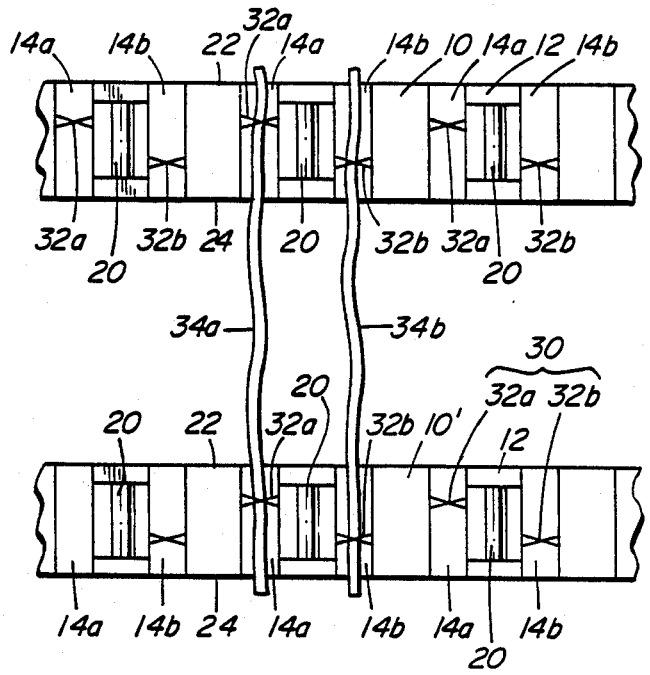
FIG. 1 PRIOR ART
FIG. 1 is a fragmentary front elevational view of parts of two adjacent prior art connectors having insulation displacement terminal arrays.
Figure 2:
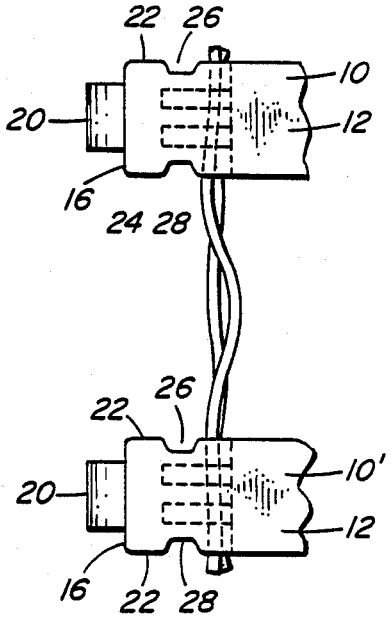
FIG. 2 PRIOR ART
FIG. 2 is a fragmentary side elevational view of parts of the prior art connectors of FIG. 1.
Figure 3:
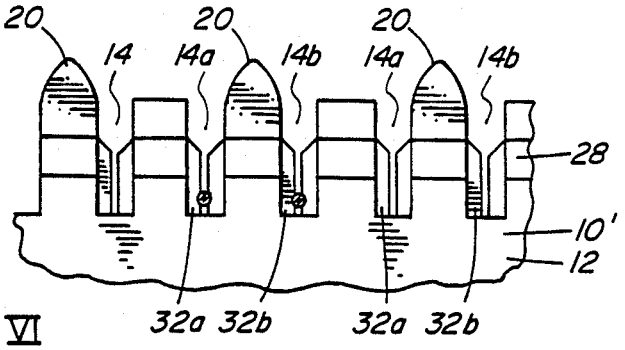
FIG. 3 PRIOR ART
FIG. 3 is a fragmentary bottom elevational view of parts of the prior art connectors of FIG. 1.

Cross-connect connectors 10 such as the Northern Telecom BIX (registered trade mark) connectors shown in FIGS. 1, 2 and 3, are commonly used in distribution frames of telephone exchanges.

Each connector 10 comprises an elongate dielectric terminal carrier 12 having a rectilinear array of vertically extending slots 14*a* and 14*b* provided in two longitudinally extending edges 16 of the terminal carrier. In the figures, a forward edge 16 only of each carrier 12 is shown. The slots 14*a* and 14*b* are in pairs, and fingers 20 project forwad from the edge 16, one finger between the individual slots of each pair. Upper and lower faces 22, 24 of the terminal carrier 12 include upper and lower longitudinally extending recesses 26, 28 respectively, disposed rearward from the forward edge 16. Each of the recesses is interrupted along its length by the slots 14.

The terminal carrier 12 carries an array of pairs of insulation displacement terminals 32*a* and 32*b*, one terminal in each slot 14*a* and 14*b* of the terminal carrier. Hence the terminals 32*a* and 32*b* of each pair are disposed one on each side of a respective finger 20. The terminals 32*a* and 32*b* are oriented so as to receive and retain insulated wires 34*a* and 34*b* aligned vertically and urged rearwardly into the slots 14 in normal use of the connector 10.

In a distribution frame (not shown), connectors 10, 10' are mounted one above another as shown in FIGS. 1 and 2. The connectors are substantially identical with reference numerals for the two connectors being the same. It is frequently necessary to connect each of a selected pair of terminals 32*a* and 32*b* of one connector 10 to a respective one of a corresponding pair of terminals 32*a* and 32*b* of an adjacent connector 10'. This is typically done by connecting a flexible wire 34 to each of the selected pair of terminals 32*a* and 32*b* of one connector and bridging each wire to a respective one of the corresponding pair of terminals 32*a* and 32*b* of the other connector.

The above operation reqires the following steps:

1. the selected pair of terminals 32*a* and 32*b* is identified 1on one connector 10;
2. a wire 34*a* is inserted into one terminal 32*a* of the selected pair with an insertion tool;
3. the corresponding pair of terminals 32*a* and 32*b* is identified on the other connector 10';
4. the wire 34*a* is run from the one terminal 32*a* to the corresponding terminal 32*a* of the other connector 10';
5. the wire 34*a* is inserted into the corresponding terminal 32*a* with the insertion tool;
6. the wire 34*a* is trimmed to length;
7. another wire 34*b* is inserted into the other terminal 32*b* of the selected pair with the insertion tool;
8. the other wire 34*b* is run from the terminal 32*b* to the corresponding terminal 32*b* of the other connector 10';
9. the other wire 34*b* is inserted into the corresponding terminal 32*b* with the insertion tool; and
10. the other wire 34*b* is trimmed to length.

Because the wires 34 cannot generally be reused, the above steps must be repeated every time such a connection is interrupted for test purposes. Moreover, the size and density of the terminals in the arrays make erroneous connections due to slight misalignment and contortions of the connecting wires 34 difficult to avoid and detect.

Figure 5:
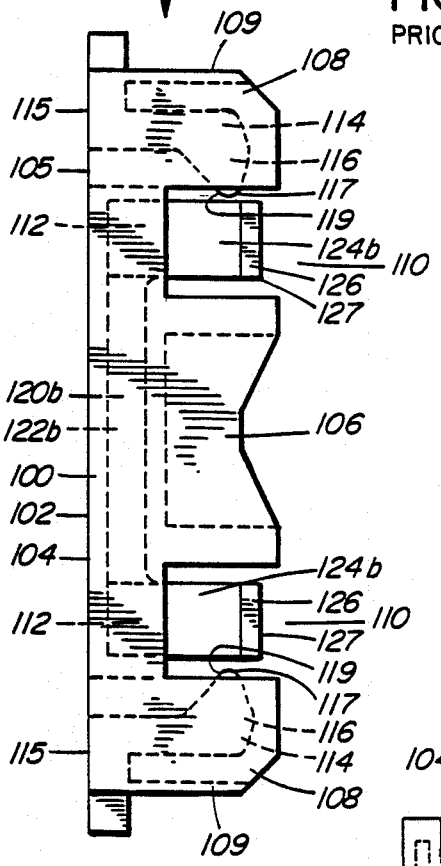
FIG. 5 is a side elevational view of the bridging link in the direction of arrow V in FIG. 4.
Figure 4:
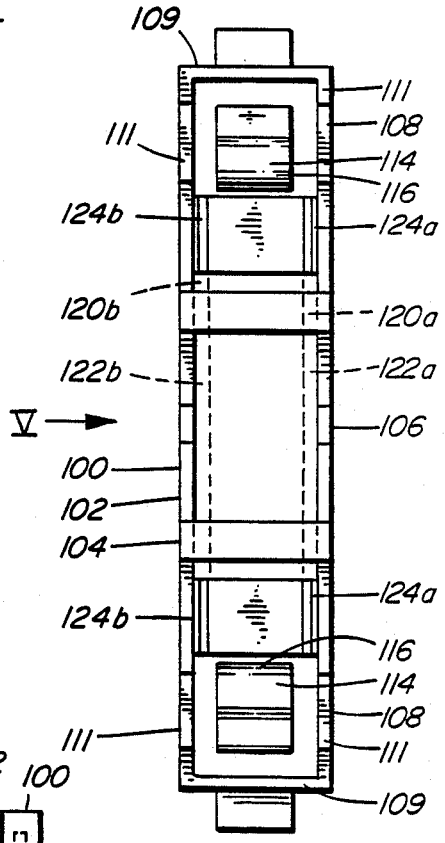
FIG. 4 is a rear elevational view of a bridging link according to a first embodiment of the invention.
Figure 6:
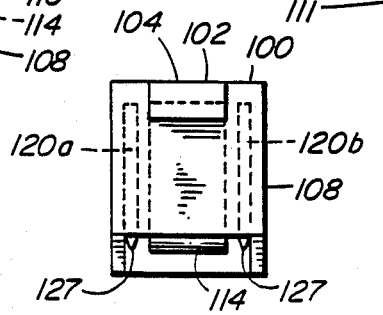
FIG. 6 is a plan view of the bridging link in the direction of arrow VI in FIG. 5.

The above problems are avoided by the use of a bridging link of the present invention. A bridging link 100 according to a first embodiment comprises a dielectric body in the form of a plastics moulding 102 (FIGS. 4, 5 and 6). The moulding 102 comprises an elongate rigid housing 104, having a front face 105, a central member 106 extending rearwardly from a central region of the housing and two channel members 108 each integrally formed with the housing at one end of the channel member and extending rearwardly from a respective end of the housing. Each channel member 108 is U-shaped when viewed from the rear (as shown in FIG. 4) and has an end wall 109 and side walls 111 to open rearwardly and inwardly toward the central member 106. The central member 106, and channel members 108 are spaced apart and, together with the housing 104, define two rectangular notches 110, each notch being rearward of the housing and between the central member and a respective channel member. The housing 104 includes two rearwardly opening recesses 112 aligned one with each notch 110.

The housing 104 carries two latching parts in the form of rearwardly extending latches 114 each latch partially enclosed within and spaced apart from the walls of a respective channel member 108. Each latch is resiliently and integrally connected at its front end to a front wall section 115 of the moulding 102 and has a head 116 at its rear free end. Each head 116 has first and second inclined camming surfaces 117, 119 which project generally in the direction of and into an associated one of the rectangular notches 110 with camming surface 119 inclined forwardly and camming surface 117 inclined rearwardly relative to the housing. Each channel member 108 protects its respective latch 114 from mechancial damage.

The housing 104 carries two laterally spaced apart metallic electrically conductive inserts 120*a* and 120*b* each of which comprises an elongate central part 122*a* or 122*b* embedded within the housing 104, and two metallic blades 124*a* and 124*b* at opposite ends of the central part. Each metallic blade 124*a* and 124*b* projects rearwardly from the housing 104 into a respective one of the notches 110 with each recess 112 disposed between two blades 124*a* and 124*b*, these blades lying parallel with opposed faces. Thus, each notch 110 is occupied by a pair of laterally spaced apart blades 124*a* and 124*b*, one on each side of its respective recess 112. A respective one of the channel members 108 is disposed outward of each pair of blades with its open side adjacent the blades. As described above, each channel member 108 partially encloses a latch 114. The camming surfaces 117, 119 of each latch 114 project through the open side of the associated channel member 108 towards an associated pair of the blades. Each blade has a free edge region 126 remote from the housing 104 which tapers toward a free edge 127. Advantageously, each blade may be provided with an inclined laterial surface region (not shown) to provide an extended area of contact with its respective insulation displacement terminal as described in a concurrently filed copending application entitled "Contact Assembly for Mating with Insulation Displacement Terminals" in the names of L. A. J. Beaulieu and G. Debortoli (Case No. 4-17).

Figure 8:
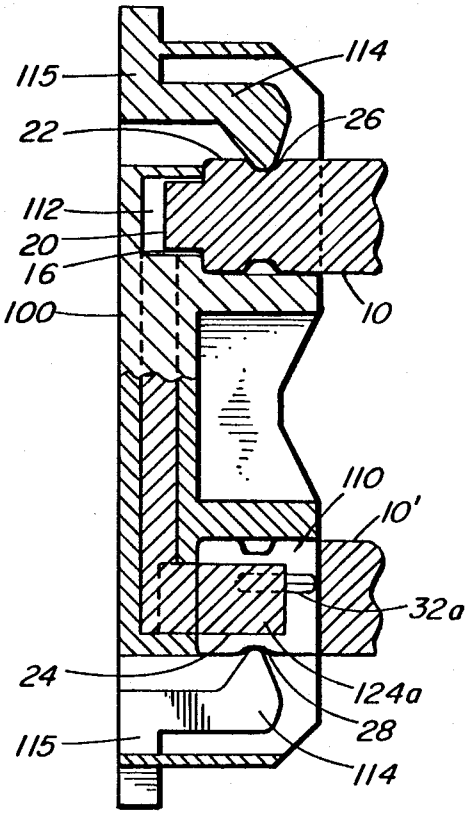
FIG. 8 is a cross-sectional view of the assembly taken along section line VIII—VIII in FIG. 7.
Figure 7:
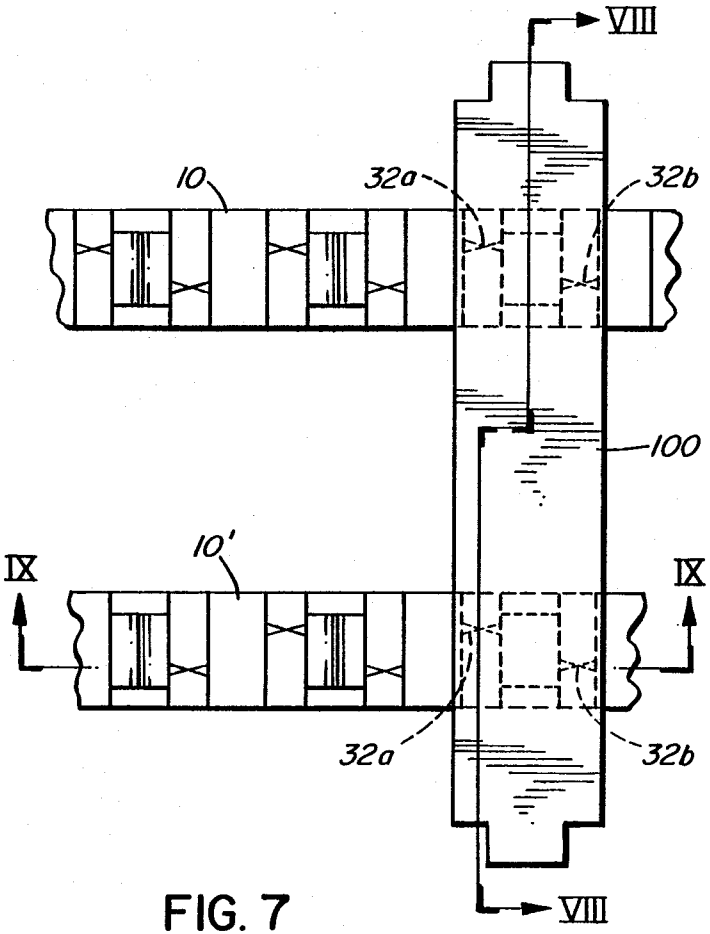
FIG. 7 is a front elevational view of the bridging link of FIG. 4 showing its assembled to and bridging between the connectors of FIG. 1.
Figure 9:
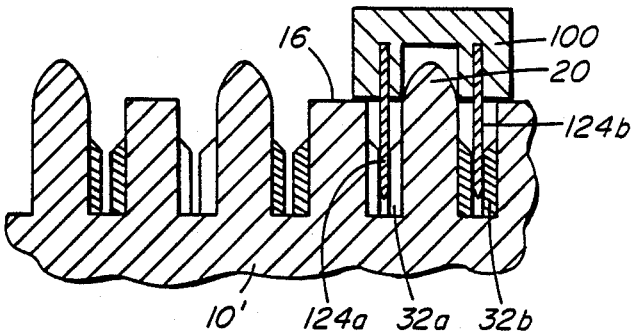
FIG. 9 is a cross-sectional view of the assemlby taken along section line IX—IX in FIG. 7.

In use of the bridging link 100 to electrically connect each of a selected pair of terminals 32*a* and 32*b* of one connector 10 to a respective one of a corresponding pair of terminals of an adjacent connector 10', the bridging link is bridged across the connectors as shown in FIGS. 7, 8 and 9. One selected pair of terminals is identified on the upper connector 10. The pair of blades 124*a* and 124*b* occupying the upper notch 110 is positioned in alignment respectively with the selected terminals 32*a* and 32*b*. This positioning of the upper pair of blades brings the pair of blades 124*a* and 124*b* occupying the lower notch 110 into alignment with the corresponding pair of terminals 32*a* and 32*b* on the lower connector 10'. The bridging link 100 is then urged rearward to force the pairs of blades 124*a* and 124*b* into respective pairs of terminals 32*a* and 32*b*. As the blades 124*a* and 124*b* enter the terminals 32*a* and 32*b*, the notches 110, of the bridging link 100 receive respective forward edges 16, of the connector 10, 10'. The fingers 20 extend between the blades 124*a* and 124*b* into the recesses 112 until the housing 104 engages the forward edges 16 of each connector on each side of the particularized finger 20 (FIG. 9). In addition, during rearward movement of the bridging link, the latches 14 of the bridging link 100 are resiliently deflected each from a normal position relatively close to its associated pair of blades 124*a* and 124*b* to a strained position further removed from said pair of blades by a camming action provided by movement of camming surfaces 117 over the forward edges 16 of the connectors. Upon reaching recesses 26 and 28, the heads 116 of the latches enter the recesses (FIG. 8) as the latches tend towards their normal unstrained positions to latch the bridging link 100 onto the connectors 10, 10'. The camming surfaces 119 permit removal of the bridging link 100 from the connectors 10, 10'.

The four blades 124*a*, 124*b* each act as electrical contact members, each making electrical contact with a respective one of the terminals 32*a*, 32*b*. The elongate central parts 122a, 122b of the metal inserts 120a, 120b act as conductive means electrically connecting upper blades 124a, 124b to lower blades 124a, 124b. Thus, the bridging link 100 provides the desired connection between a pair of terminals 32a and 32b on one connector 10 with respective terminals 32a and 32b on the other connector 10'.

The notches 110 of the bridging link 100 cooperate with the forward edges 16 of the connectors 10, 10' to ensure proper placement of the bridging link on the connectors. The recesses 112 of the bridging link 100 and the fingers 20 of the connectors 10, 10' cooperate to act as complementary keying parts to ensure proper placement of the bridging link on the connectors. The latches 114 of the bridging link 100 and the recessors 26, 26' of the connectors 10, 10' cooperate to act as complementary latching parts to releasably latch the bridging link onto the connectors.

Note that installation of the bridging link 100 requires only the following three steps, in contrast to the ten steps required for the conventional procedure:

1. identify the selected pair of terminals 32a and 32b on one connector 10;
2. align the upper pair of blades 124a and 124b with the selected pair of terminals; and
3. urge the bridging link 100 rearward to make the connection.

No insertion and trimming tools are required for the above steps. The rigidity of the bridging link 100 prevents erroneous connections due to misalignment. Moreover, the bridging link 100 is readily disconnected and reconnected for test purposes. The camming surfaces 119 provide for disengagement of the latches 114 as the bridging link 100 is urged forwardly off the connectors 10, 10' during removal.

Figure 10:
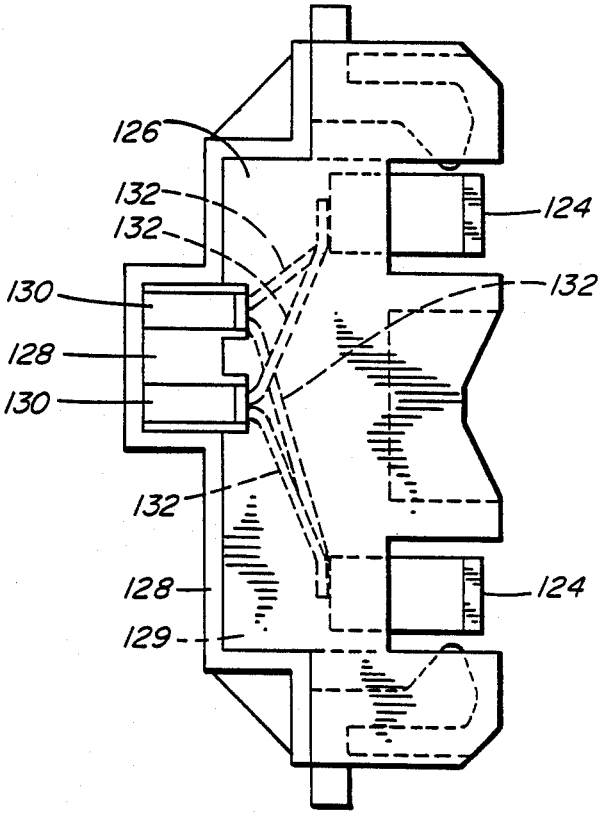
FIG. 10 is a side elevational view of a bridging link according to a second embodiment of the invention.
Figure 11:
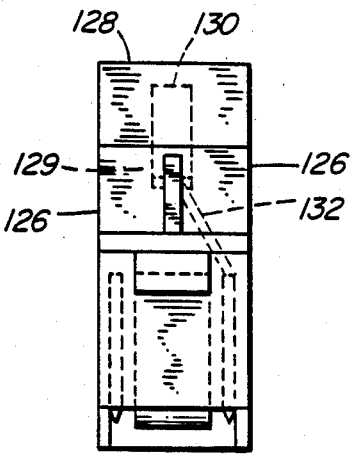
FIG. 11 is a plan view of the bridging link of FIG. 10.
Figure 12:
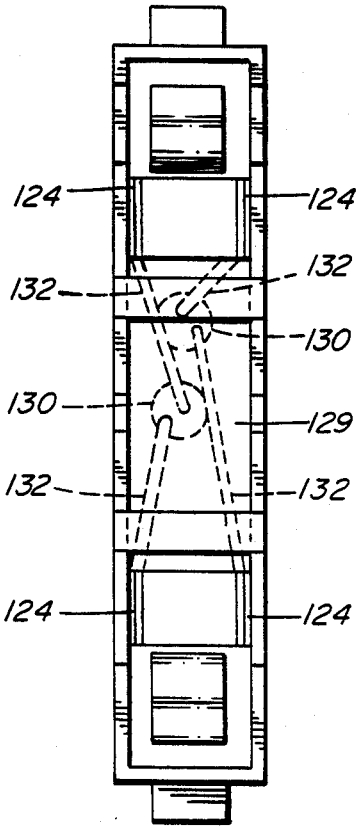
FIG. 12 is a rear elevational view of the bridging link of FIG. 10.

In a second embodiment of the invention, shown in FIGS. 10, 11 and 12, the elongate central parts 122 of the metallic inserts 120 of the first embodiment are omitted and the rigid housing 104 of the first embodiment is modified to include forwardly extending side walls 126 and a forward cover 128 fitted to the side walls to define a cavity 129 (FIG. 12). A pair of fuses 130 each having a pair of leads 132 is carried by the housing 104 in the cavity 129, each lead making electrical contact with a respective one of the blades 124 so as to provide fusible electrical connections between the pairs of electrical contact members. Such connections are useful for sneak current protection for ground-start PBX connections.

What is claimed is:

1. A bridging link for electrically connecting each of a selected pair of insulation displacement terminals of a first array of pairs of insulation displacement terminals carried by a first terminal carrier to a respective one of a corresponding pair of insulation displacement terminals of a second array of insulation displacement terminals carried by a second terminal carrier, comprising:

a dielectric body comprising a rigid housing;

a first pair of spaced apart rigid electrical contact members projecting from a first region of the rigid housing, each contact member of the first pair for insertion into a respective one of the selected pair of terminals to make electrical contact therewith; and a second pair of spaced apart rigid electrical contact members projecting from a second region of the rigid housing and spaced apart from the first region, each contact member of the second pair for insertion into a respective one of the corresponding pair of terminals to make electrical contact therewith;

the contact members of the first pair electrically connected through the rigid housing each to a respective one of the contact members of the second pair.

2. A bridging link as defined in claim 1, wherein each contact member projects from the housing and has a free edge region remote from the housing, the free edge region terminating in a free edge of the contact member and being tapered toward the free edge for insertion into an insulation displacement terminal.

3. A bridging link as defined in claim 1, wherein the body carries latching parts to releasably latch the bridging link onto the terminal carriers.

4. A bridging link as defined in claim 3, wherein two latching parts are provided and the first and second pairs of contact members are disposed between the latching parts.

5. A bridging link as defined in claim 4 wherein each latching part comprises a latch integrally formed with the housing at a base of the latch and resiliently movable from a normal position relatively close to an associated one of the pairs of contact members to a strained position further removed from said associated pair of contact members.

6. A bridging link as defined in claim 5, wherein each latch has first and second camming surfaces remote from its base with the camming surfaces inclined in opposite directions and projecting towards the pair of contacts associated with said latch.

7. A bridging link as defined in claim 6, further comprising a pair of channel members integrally formed with the housing at one end of the channel member, each channel member having an open side adjacent an associated one of the pairs of contact members and partially enclosing an associated one of the latches with the camming surfaces of the latch projecting through the open side of the channel member towards the pair of contact members associated with the latch.

8. A bridging link as defined in claim 1, wherein the body is formed with two notches into each of which one of the pairs of contact members extends, each said notch provided as a location notch for proper placement of the bridging link on the terminal carriers.

9. A bridging link as defined in claim 8, wherein the housing is formed with two recesses, one between each of the pairs of contact members.

10. A bridging link as defined in claim 1, comprising a conductive means extending between each contact member of the first pair and its associated contact member of the second pair, the conductive means including a fuse.

* * * * *